US005715368A

United States Patent [19]

Saito et al.

[11] Patent Number: 5,715,368

[45] Date of Patent: Feb. 3, 1998

[54] SPEECH SYNTHESIS SYSTEM AND METHOD UTILIZING PHENOME INFORMATION AND RHYTHM IMFORMATION

[75] Inventors: Takashi Saito, Tokyo-to; Masaaki Okochi, Yokohama, both of Japan

[73] Assignee: International Business Machines Corporation, Armonk, N.Y.

[21] Appl. No.: 495,155

[22] Filed: Jun. 27, 1995

[30] Foreign Application Priority Data

Oct. 19, 1994 [JP] Japan ..... 6-253190

[51] Int. Cl.[6] ..... G10L 5/04

[52] U.S. Cl. ..... 395/2.77; 395/2.69

[58] Field of Search ..... 395/2.77, 2.67, 395/2.69, 2.66, 2.64, 2.63, 2.75

[56] References Cited

U.S. PATENT DOCUMENTS

| | | | |
|---|---|---|---|
| 3,892,919 | 7/1975 | Ichikawa | 395/2.76 |
| 4,862,504 | 8/1989 | Nomura | 395/2.69 |
| 5,220,629 | 6/1993 | Kosaka et al. | 395/2.69 |
| 5,283,833 | 2/1994 | Church et al. | 395/2.61 |
| 5,396,577 | 3/1995 | Oikawa et al. | 395/2.69 |

OTHER PUBLICATIONS

IEEE Transactions on Consumer electronics, Goto et al, "Microprocessor Based English Speech Training System", pp. 824–834, vol. 34, No. 3, Aug. 1988.

*Primary Examiner*—Allen R. MacDonald
*Assistant Examiner*—Richemond Dorvil

[57] ABSTRACT

To synthesize speech, which is clear and high in naturalness, in a Japanese-language speech synthesis system by improving not only phoneme information but also rhythm information. In the Japanese-language, the independent word speech and the adjunct word speech are remarkably different in speech characteristic. The difference in speech characteristics between them is clearly observed, particularly in rhythmical elements such as the intensity, speech, and pitch of speech. From this fact, there is provided a new rule synthesis method which uses as a speech synthesis unit an adjunct word chain unit comprising a chain of one or more adjunct words and which is capable of synthesizing speech whose naturalness is high. The portion other than the adjunct word portion, i.e., the independent word portion, is constituted in a CV/VC unit.

15 Claims, 3 Drawing Sheets

SPEECH SYNTHESIS SYSTEM AND METHOD UTILIZING PHENOME INFORMATION AND RHYTHM IMFORMATION

FIELD OF THE INVENTION

The present invention relates to a method and system for synthesizing speech from data provided in the form of a text file, based on speech waveform data prepared in advance.

BACKGROUND OF THE INVENTION

Various attempts to obtain high-quality synthetic speech by making use of a large quantity of speech data have been made extensively in recent years. The following are known to be typical speech synthesis unit dictionaries (speech databases) used in these attempts:

(1) A speech synthesis unit dictionary in which about 6000 important words are recorded (Sagisaka, "Japanese Speech Synthesis Using Various Phonemic Connection Units," Shingaku Technical Report, SP87-136).

(2) A speech synthesis unit dictionary in which text read for several hours by an announcer is recorded as is (Hirokawa, "Rule Synthesis Method Using Waveform Dictionary," Shingaku Technical Report, SP88-9).

On the assumption that a speech database includes a large number of phonemic chains, both of the selection methods of a synthesis unit using the above-described dictionaries have focused on a method for searching for a synthesis unit in the database in which optimum synthesis unit strings are provided, and have not positively referenced utilizing philogical characteristics, such as an independent word plus an adjunct word section, in the synthesis unit. These methods will hereinafter be described in brief. In (1), on the assumption that a limitation is not provided on the length of the synthesis unit, by evaluating four standards, which comprises the storage of CV connections (space between C and V is not regarded as a unit boundary), voiced sound sequence priority (a penalty is imposed on the connection of a vowel sequence), long unit priority (to reduce the connection, a long unit has priority), and degree of interunit overlapping (words having many common parts including a unit to be connected have priority), in the recited sequence, an optimum synthesis unit string of a given phonemic series is searched from an important word database. In (2), the length of a synthesis unit is regarded as a phoneme unit, and the five selection standards, meaning a phonemic environment, a pitch average value, an inclination of pitch, a phonemic time length, and a phonemic amplitude, are expressed in terms of an evaluation function in which the degree of equality between the environment to be used and the environment in a database is numerically expressed. By applying this evaluation function to a given phonemic series in sequence, an optimum synthesis unit string is obtained from a massive database such as in (2).

It is thought that the following two big problems have remained even in the above-described prior art:

(a) Improvement of Rhythm Information Reproducibility

To synthesize speech which is clear and high in naturalness, both of phoneme information and rhythm information are an important element. An object of the above-described system is to improve the quality of synthetic speech by improving the reproducibility of phoneme information by making use of a database, but the reproducibility of rhythm information has not been considered. It is further thought that speech synthesis close to human voice becomes possible by improving not only the reproducibility of phoneme information but also the reproducibility of rhythm information.

(b) Database Optimization

Since, in the above-described system, no optimization of the vocabulary set has been performed, the coefficient of utilization of a database is predicted to be low. From the standpoint of practical use, it is thought that the construction of a speech database considering even a coefficient of utilization and a synthesis unit selection method based on that construction are an important consideration.

SUMMARY OF THE INVENTION

An object of the present invention is to provide a method and system which is capable of synthesizing speech, which is clear and high in naturalness, by improving not only phoneme information but also rhythm information, particularly in a Japanese-language speech synthesis system.

From a grammatical point of view, the Japanese language comprises an independent word portion and an adjunct word chain portion. When Japanese is considered a speech language, it can also be considered to consist of independent word speech and adjunct word speech. The independent word speech and adjunct word speech are markedly different in speech characteristics. The difference in speech characteristics between them is clearly observable, particularly in rhythmical elements such as the intensity, speed, and pitch of speech. The result will have a large influence on the clearness and naturalness of synthesized speech. For example, in the speech of the independent word portion, the clearness of individual phonemes often becomes a basic requirement for understanding words. In adjunct word speech, the smoothness of a united unit, i.e., the naturalness, often becomes predominant in understanding the meaning of a passage, rather than the clearness of individual phonemes.

In view of these facts, the present invention proposes a new rule synthesis method which is capable of synthesizing speech whose naturalness is high by using an adjunct word chain unit as a speech synthesis unit.

The present invention solves the problem of (a) by utilizing the philogical characteristic of an independent word plus an adjunct word section in database construction or synthesis unit selection. Particularly with regard to the adjunct word portion, as a method to reproduce a speech characteristic including the side of rhythm, a speech synthesis unit comprising an adjunct word chain is proposed. An introduction of this adjunct word chain into a synthesis unit dictionary (speech database) can also be regarded as the hierarchization of a synthesis unit dictionary and is considered to be a method which is congenial even with the problem of (b).

In the present invention, a rule synthesis method using an adjunct word chain unit as a synthesis unit is proposed to express the difference in speech characteristics between an independent word and an adjunct word, and the above-described problems of the prior art are solved. The following advantages can be expected according to the present invention.

The Possibility of the Synthesis of Speech Whose Naturalness is High

While the synthesis of independent word speech should be assumed to be the synthesis of an infinite vocabulary, the synthesis of adjunct word speech can be regarded as a rule synthesis near to a recorded edit of a finite and yet approximately 1000-word vocabulary. Therefore, a speech synthesis of high quality becomes possible without excessively deteriorating the quality of the original speech. As a result, dynamic changes in pitch and phoneme time length near to the human voice, which are difficult to realize in a conventional rhythm model, can be synthesized.

Easy Applications to Emphasis Expressions

There is a good correspondence between the independent word plus adjunct word section and the synthesis unit section. Therefore, if two types of synthesis units of normal speech and emphasis speech are prepared in advance for an adverb and a postpositional word functioning auxiliarily to a main word, speech of an emphasis expression will also be able to be synthesized simply by replacement of the synthesis unit.

DETAILED DESCRIPTION OF THE PREFERRED EMBODIMENT

An embodiment of the present invention will hereinafter be described with reference to the drawings.

A. Hardware Construction

Figure 1:
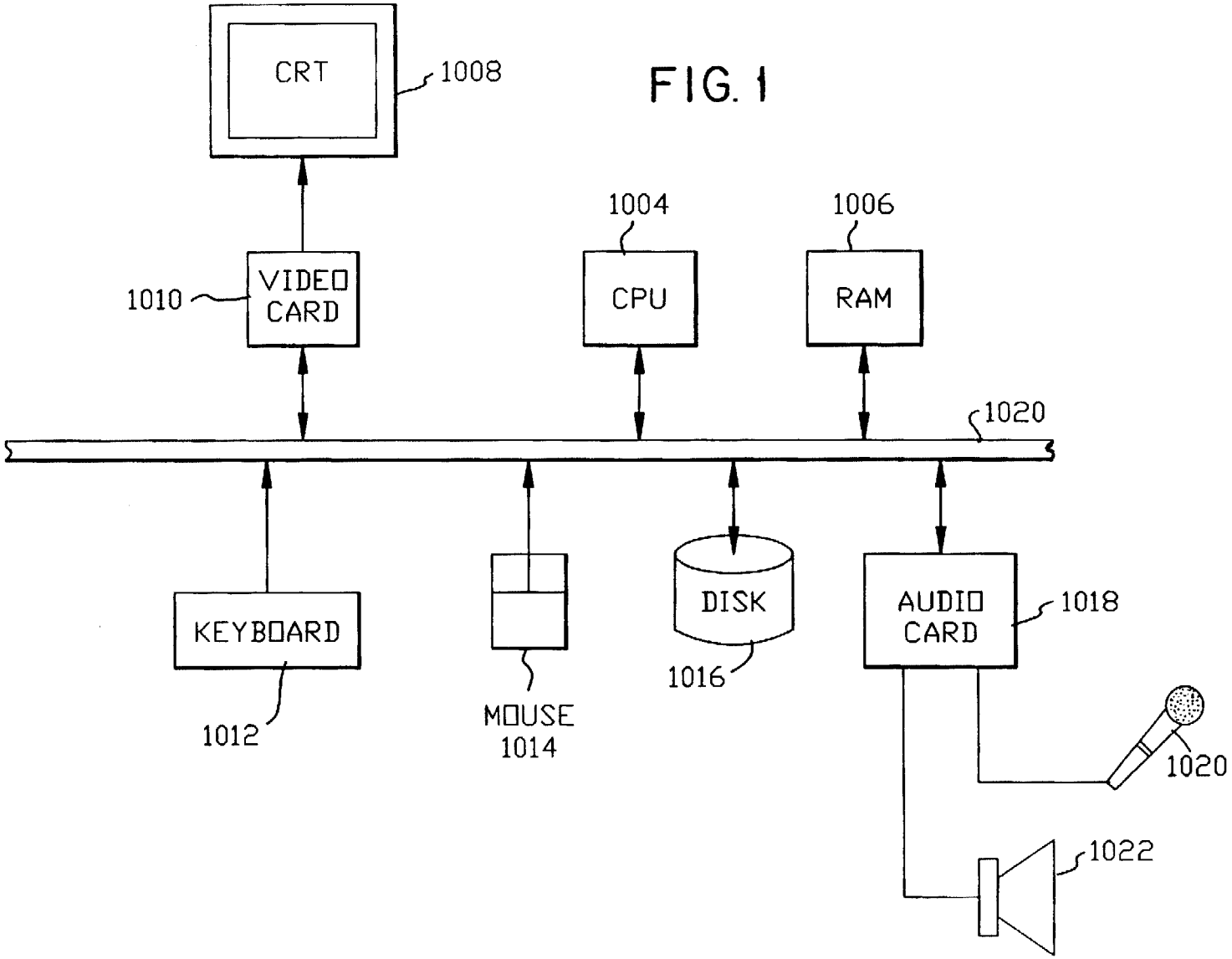
FIG. 1 is a block diagram of the hardware configuration for implementing the present invention.

Referring to FIG. 1, there is shown the hardware construction for implementing the present invention. In this construction, a CPU 1004 for performing calculation and input-output control, a RAM 1006 for providing buffer regions for program loading and arithmetic operation, a CRT unit 1008 for displaying characters and image information on the screen thereof, a video card 1010 for controlling the CRT unit 1008, a keyboard 1012 which enables an operator to input commands and characters, a mouse 1014 for pointing to an arbitrary point on the screen and then sending information on that position to a system, a magnetic disk unit 1016 for permanently storing programs and data so that they can be read and written, a microphone 1020 for speech recording, and a speaker 1022 for outputting synthesized speech as sound are connected to a common bus 1002.

Particularly, in the magnetic disk unit 1016, there are stored an operating system that is loaded when the system is started, a processing program according to the present invention which will be described later, digital speech files fetched from the microphone 1020 and audio-digitally (A/D) -converted, a dictionary of the synthesis units of phonemes obtained from the result of analysis of speech files, and a word dictionary for text analysis.

An operating system suitable for processing the present invention is OS/2 (trademark of IBM) but it is also possible to use an arbitrary operating system providing an interface with an audio card, such as MS-DOS (trademark of Microsoft), PC-DOS (trademark of IBM), Windows (trademark of Microsoft), and AIX (trademark of IBM).

The audio card 1018 may comprise any card which can convert a signal input as speech through the microphone 1020 to a digital form such as PCM and which can also output the data in such a digital form as speech through the speaker 1022. An audio card provided with a digital signal processor (DSP) is highly effective and suitable as the audio card 1018. The DSP is not indispensable to the present invention, however.

For the data input as speech through the microphone 1020 and converted to a digital form such as PCM, a process such as a Wavelet conversion process is performed, the converted waveform is pitch-extracted, and a pitch-marked waveform is stored in a synthesis unit dictionary 2012, which will be described later.

B. Logical Construction

Figure 2:
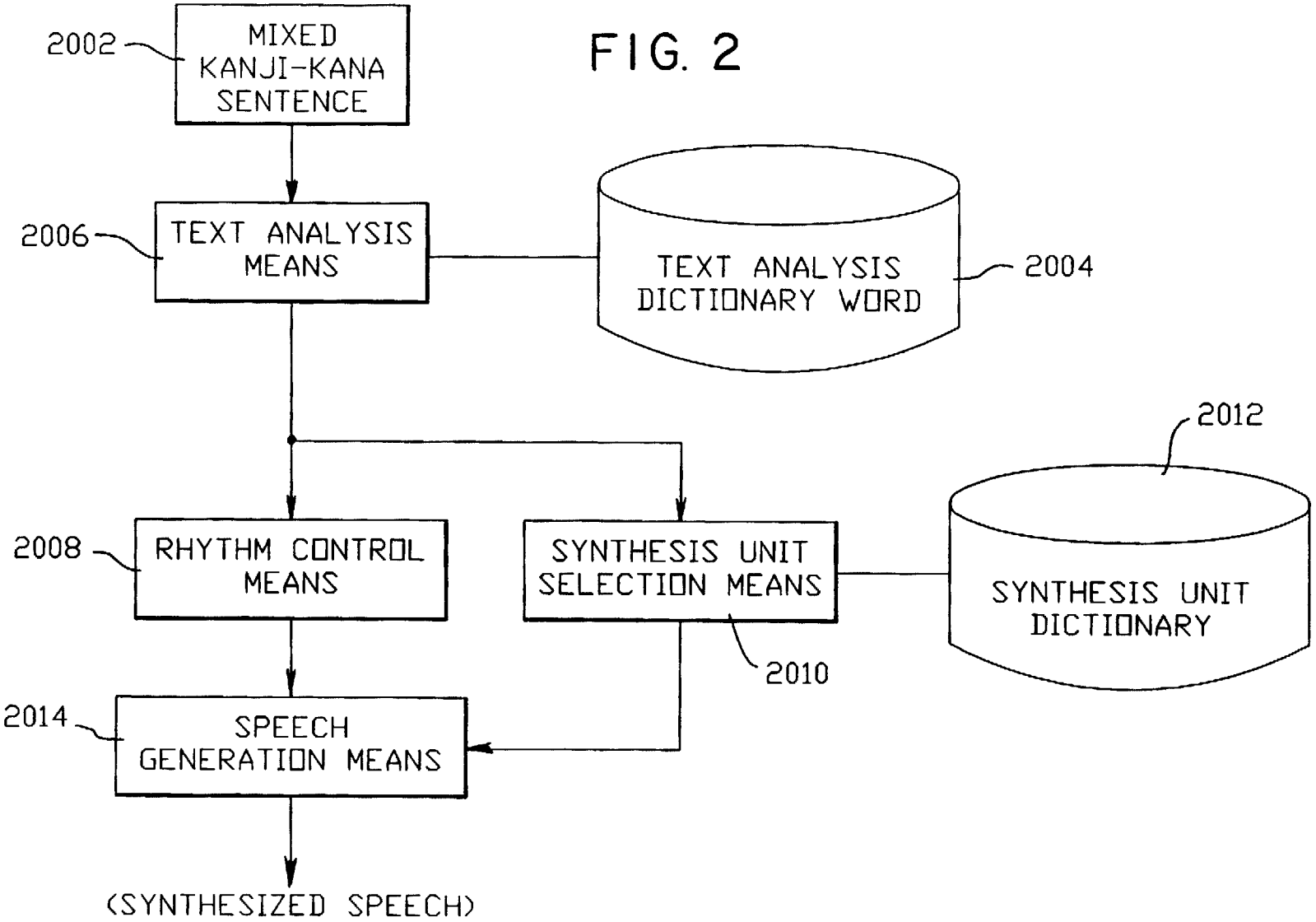
FIG. 2 is a block diagram of processing elements for performing speech synthesis processing.

The logical construction of the speech synthesis system of the present invention will be described with reference to FIG. 2. The data, which is input to this speech synthesis system, is typically a shift-JIS text file 2002 of a mixed kanji-kana sentence. A plurality of words for text analysis, and the reading, accent, and part of speech for each word are stored in a text analysis word dictionary 2004.

If the mixed kana-kanji text file 2002 is input to a text analysis means 2006, the text analysis means 2006 will resolve the input mixed kana-kanji sentence into elements through a morphological analysis process and, at the same time apply reading and accent to each of the resolved elements, by referencing the text analysis word dictionary 2004. The text analysis means 2006 further performs modification analysis for the input mixed kana-kanji sentence and generates information on a sentence structure which will be needed in rhythm control means 2008.

The rhythm control means 2008 performs the generation of a pitch pattern, the setting of a rhythm time length, the correction of rhythm power, and the setting of a stop duration length, based on the information on the sentence structure provided by the text analysis means 2006.

A synthesis unit selection means 2010 performs the selection of a synthesis unit. More particularly, the synthesis unit selection means 2010 sections a rhythm series (string of reading) into an independent word portion and an adjunct word portion so that the present invention can be utilized.

For this purpose, a synthesis word dictionary 2012 is prepared in advance. The synthesis word dictionary 2012 includes an independent word synthesis unit dictionary and an adjunct word chain synthesis unit dictionary.

For the independent word portion, the synthesis unit selection means 2010 searches the independent word synthesis unit dictionary and constructs a word string from the independent word unit. Also, for the adjunct word portion, the synthesis unit selection means 2010 searches the adjunct word chain synthesis unit dictionary and constructs a synthesis unit string from the adjunct word chain unit. Also, in a case in which a part of the phoneme series of the adjunct word portion cannot be constructed using an entry from the adjunct word chain synthesis unit dictionary, the synthesis unit string will be complemented by searching the independent word synthesis unit dictionary. Since the independent word synthesis unit dictionary is constructed such that an infinite vocabulary can be synthesized, there is no possibility that there exists a phoneme string that cannot be complemented. The synthesis unit series of the input phoneme series is obtained in this way. Further, for the adjunct word portion, the rhythm information of the adjunct word chain unit is sent to the rhythm control means 2008, and a correction process of the rhythm information to a synthesis environment is performed. This correction process is performed to smoothly connect the entire pitch pattern and time length of the adjunct word chain portion, which was sent from the adjunct word chain synthesis unit dictionary, with the rhythm information of the independent word portion generated using the rhythm model.

The speech generation means 2014 generates a speech waveform by connecting the synthesis unit series sent by the synthesis unit selection means 2010, based on the rhythm information obtained by the rhythm control means 2008. The synthesized speech waveform is output through the audio card 1018 of FIG. 1 from the speaker 1022.

C. Synthesis Unit Dictionary

The above-described synthesis unit dictionary 2012 will hereinafter be described further in detail.

The synthesis unit dictionary 2012 of the present invention consists of the independent word synthesis unit dictionary and the adjunct word chain synthesis unit dictionary, as described above. The independent word synthesis unit dictionary is a synthesis unit dictionary for synthesizing an infinite vocabulary and, in a Japanese-language sentence, is mainly employed to synthesize an independent word portion. Since, however, the adjunct word chain synthesis unit dictionary is a dictionary used in the speech synthesis of the adjunct word portion in a sentence and holds the rhythm information for the adjunct word portion, speech whose naturalness is high can be synthesized by utilizing this dictionary. These dictionaries will hereinafter be described.

C1. Adjunct Word Chain Synthesis Unit Dictionary

The adjunct word chain unit is sectioned at the leading and trailing ends thereof by an independent word or punctuation mark and is a portion in which one or more adjunct words continue. Therefore, the adjunct word chain unit includes not only a chain of two adjunct words such as "koso" and "ga" in "onseikosoga," but also a single adjunct word such as "ha" in "gakkouha." To construct an adjunct word chain synthesis unit dictionary, the statistics of the adjunct word are obtained from a Japanese-language text database, and a precedence process based on the frequency of appearance and chain length is performed. There is the possibility that, in principle, the number of chain combinations of adjunct words which are about 300 words is infinite. However, in fact, more than 90% chain combinations can be covered by about 1000 combinations which are higher in the frequency of appearance. In this embodiment, the about 1000 combinations are used as adjunct word chain synthesis units.

While it is usual that, in a general idea, an adjunct word unit as a part-of-speech section unit such as "koso" and "ga" is employed as a speech synthesis unit, in the present invention, the speech synthesis unit is not the adjunct word unit but an adjunct word chain unit such as "kosoga" and "nanodearo." The main reason is that it is thought that an object of this synthesis unit is to produce a large effect by including not only a connection unit of phoneme information but also a connection unit of rhythm information, and an adjunct word chain unit near to a unit of a unity of rhythmical characteristics (particularly pitch patterns and amplitude patterns) is more suitable.

Also, as an expansion of the adjunct word chain synthesis unit dictionary, since the speech synthesis unit section corresponds to a language section such as an independent word plus an adjunct word section, two types of synthesis units, of normal speech and emphasis speech, are prepared in advance for an adverb and a postpositional word functioning as an auxiliary to a main word and are stored in the synthesis unit dictionary 2012. In this manner, speech of an emphasis expression can also be synthesized simply by replacement of the synthesis unit of emphasis speech.

C2. Independent Word (Infinite Vocabulary) Synthesis Unit Dictionary

Since the synthesis of independent word speech and the synthesis of the adjunct word chain portion not existing in the adjunct word chain unit are the speech synthesis of an infinite vocabulary, a unit utilizing a language section cannot be used. Therefore, a unit dictionary of the size corresponding to a storable capacity is constructed. Basically, like the prior art, the unit dictionary is constructed in a CV/VC unit. When the capacity is large, the unit dictionary is constructed in a unit longer than the coincidence of a phoneme environment (e.g., VCV, CVC, a word, etc.). C represents a consonant and V represents a vowel. CV represents a synthesis unit including a transition portion from a consonant to a vowel and VC represents a synthesis unit including a transition portion from a vowel to a consonant. A unit system using CV and VC together has been used widely in the synthesis of Japanese-language speech. In the speech synthesis of a portion in which the independent word (infinite vocabulary) synthesis unit dictionary is used, since rhythm information has not been held, rhythm control is performed based on a rhythm control rule.

D. Rhythm Control Method for Adjunct Word Chain Synthesis Unit

According to one characteristic of the present invention, in the adjunct word chain synthesis unit dictionary, not only speech data but also a rhythm pattern are held for each adjunct word chain entry. The rhythm pattern used herein is defined as follows: A portion (corresponding to an accent component) obtained by subtracting from the pitch pattern of an adjunct word chain portion (which represents a change of time in a log-fundamental frequency) the inclination of the chain portion (corresponding to a tone component) is recorded in the center-of-gravity position of each of the phonemic segments constituting the adjunct word chain portion. This recorded portion is the above-described rhythm pattern.

Figure 3:
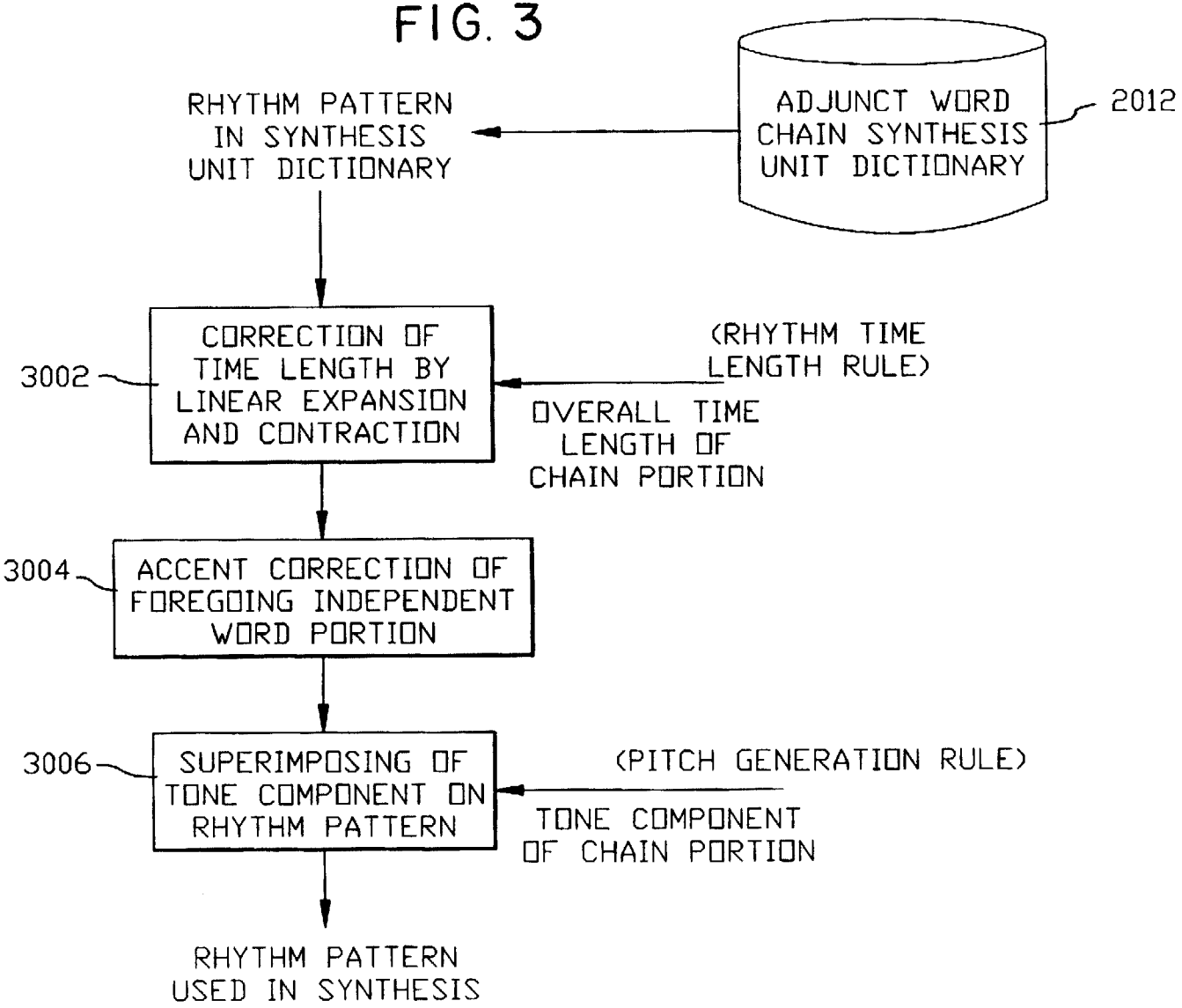
FIG. 3 is a flowchart of the rhythm control of an adjunct word chain unit.

The processing flowchart of the rhythm control of the adjunct word chain unit which is performed at the time of synthesis is shown in FIG. 3. For the rhythm pattern in the synthesis unit dictionary extracted from the adjunct word chain synthesis unit dictionary, in step 3002 of FIG. 3, the segment position of each rhythm is corrected so that the time length of the adjunct word chain portion becomes equal to the time length generated in the rhythm control means 2008 by a rule, by linearly expanding and contracting the time length of the adjunct word chain portion. Next, in step 3004, the correction of an accent level by the coupling of the independent word portion and the adjunct word chain portion is made. When the adjunct word chain portion is accent-coupled with the foregoing independent word portion, the accent level of the independent word portion obtained by a rule is equalized with that of the rhythm pattern of the adjunct word chain portion. Note that, when there is no accent-coupling, this correction is unnecessary. Finally, in step 3006, the pitch pattern to be synthesized is obtained by superimposing the inclination removing pitch pattern of the adjunct word chain portion at the corrected center-of-gravity position of each phonemic segment on the tone component generated by a rule. In this way, the rhythm pattern in the synthesis environment is obtained for the adjunct word chain portion.

For the power, information on an original speech is thought to be sufficiently effective in its original condition, so, in this embodiment, only the smoothing operation of a unit is performed in front and in back and, basically, the data of an original speech is not changed.

E. Concrete Example of Speech Synthesis using an Adjunct Word Chain Unit

As one example, in a sentence including an emphasis, such as "Onshitsu kosoga, mottomo taisetsu nanodearo. (It will be a sound quality that is most important.)," application of the method of the present invention will be explained for an example of a connection pattern of a synthesis unit.

In this example sentence, "Onshitsu" and "taisetsu" are synthesized as before with an independent word (infinite vocabulary) synthesis unit such as a CV/VC unit.

The "kosoga" and the "nanodearo", on the other hand, are synthesized with the adjunct word chain unit, and information from the synthesis unit dictionary is also used for the rhythm information. Therefore, a dynamic rhythm near to that of the human voice can be synthesized.

Further, an entry to the synthesis unit dictionary of emphasis words is used for the part of "mottomo." For this, as with the adjunct word chain unit, rhythm information of the synthesis unit dictionary is also used. Therefore, the intonation at the time of emphasis can easily be synthesized.

Advantages of the Invention

As has been described hereinbefore, for adjunct word chain units whose frequency is relatively high, the synthesis units, including rhythm information, are stored in advance in the synthesis unit dictionary. Therefore, in speech synthesis processing based on a text file, a dynamic rhythm which is near to that of the human voice, and natural, can be synthesized according to the speech synthesis method of the present invention.

We claim:

1. A speech synthesis system for synthesizing speech based on input text data, comprising:

(a) a text analysis word dictionary in which a plurality of words and at least the reading, accent, and part of speech for each word are stored;

(b) a text analysis means for resolving said input text data into elements by morphological analysis and providing information on the reading, accent, and part of speech of each of the resolved elements by referencing to said text analysis word dictionary and also providing information on the text structure of said text data;

(c) a rhythm control means for generating a pitch pattern and setting a phonemic power and a phonemic time length, based on said information provided by said text analysis means;

(d) a synthesis unit dictionary in which an independent word synthesis unit dictionary including a plurality of independent word synthesis units and an adjunct word chain synthesis unit dictionary including a plurality of adjunct word chain synthesis units are stored;

(e) a synthesis unit selection means for obtaining, based on said information on the part of speech provided by said text analysis means, necessary independent word synthesis units from said independent word synthesis unit dictionary in response to said part of speech being an independent word and for obtaining corresponding adjunct word chain synthesis units from said adjunct word chain synthesis unit dictionary in response to an adjunct word chain being found; and (f) a speech generation means for outputting synthetic speech, based on said pitch pattern, phonemic power, and phonemic time length provided by said rhythm control means and on said synthesis units provided by said synthesis unit selection means.

2. The speech synthesis system as set forth in claim 1, wherein each of said adjunct word chain synthesis units of said adjunct word chain synthesis unit dictionary is stored in connection with phonemic information.

3. The speech synthesis system as set forth in claim 2, which further comprises a means for providing said phonemic information contained in said adjunct word chain synthesis unit to said rhythm control means so that said pitch pattern and phonemic time length provided by said rhythm control means are changed.

4. The speech synthesis system as set forth in claim 1, wherein said text data is Japanese text data including kanji and kana characters.

5. The speech synthesis system as set forth in claim 4, wherein said text data is shift-JIS (Japanese Industrial Standards) text data.

6. The speech synthesis system as set forth in claim 1, wherein said independent word synthesis unit is a consonant-vowel/vowel-consonant (CV/VC) unit.

7. The speech synthesis system as set forth in claim 6, which further comprises a means for expressing, in response to a corresponding adjunct word chain synthesis unit being not found in said adjunct word chain synthesis unit dictionary, the adjunct word chain synthesis unit in the independent word synthesis unit.

8. The speech synthesis system as set forth in claim 7, wherein said synthesis unit dictionary further includes an emphasis word synthesis unit dictionary, and said synthesis unit selection means has a function of selecting, in response to the emphasis word being found, an emphasis word synthesis unit corresponding to said emphasis word.

9. A speech synthesis method for synthesizing speech based on input text data, comprising the steps of:

(a) preparing a text analysis word dictionary in which a plurality of words and at least the reading, accent, and part of speech for each word are stored;

(b) preparing a synthesis unit dictionary in which an independent word synthesis unit dictionary including a plurality of independent word synthesis units and an adjunct word chain synthesis unit dictionary including a plurality of adjunct word chain synthesis units are stored;

(c) resolving said input text data into elements by morphological analysis, and providing information on the reading, accent, and part of speech for each of the resolved elements by referencing said text analysis word dictionary and also providing information on the text structure of said text data;

(d) a rhythm control means for generating a pitch pattern and setting a phonemic power and a phonemic time length, based on said information on the text structure provided by said step (c);

(e) obtaining, based on said information on the part of speech provided by said step (c), necessary independent word synthesis units from said independent word synthesis unit dictionary in response to said part of speech being an independent word, and obtaining corresponding adjunct word chain synthesis units from said adjunct word chain synthesis unit dictionary in response to an adjunct word chain being found; and (f) outputting synthetic speech, based on said pitch pattern, phonemic power, and phonemic time length provided by said step (d) and on said synthesis unit selection means.

10. The speech synthesis method as set forth in claim 9, wherein each of said adjunct word chain synthesis units of said adjunct word chain synthesis unit dictionary is stored in connection with phonemic information.

11. The speech synthesis method as set forth in claim 10, which said step (d) further has the step of changing said pitch pattern and phonemic time length by inputting said phonemic information contained in said adjunct word chain synthesis unit.

12. The speech synthesis method as set forth in claim 9, wherein said text data is Japanese text data including kanji and kana characters.

13. The speech synthesis method as set forth in claim 12, wherein said text data is shift-JIS text data.

14. The speech synthesis method as set forth in claim 9, wherein said independent word synthesis unit is a CV/VC unit.

15. The speech synthesis method as set forth in claim 14, which further comprises the step of expressing, in response to a corresponding adjunct word chain synthesis unit not being found in said adjunct word chain synthesis unit dictionary, the adjunct word chain synthesis unit in the independent word synthesis unit.

* * * * *